US008875339B2

(12) United States Patent
Dobson, III

(10) Patent No.: US 8,875,339 B2
(45) Date of Patent: Nov. 4, 2014

(54) DUSTPAN

(71) Applicant: Eben W. Dobson, III, Solana Beach, CA (US)

(72) Inventor: Eben W. Dobson, III, Solana Beach, CA (US)

( * ) Notice: Subject to any disclaimer, the term of this patent is extended or adjusted under 35 U.S.C. 154(b) by 0 days.

(21) Appl. No.: 13/749,020

(22) Filed: Jan. 24, 2013

(65) Prior Publication Data

US 2014/0130288 A1 May 15, 2014

Related U.S. Application Data

(60) Provisional application No. 61/726,802, filed on Nov. 15, 2012.

(51) Int. Cl.
*A47L 13/52* (2006.01)

(52) U.S. Cl.
CPC ..... *A47F 13/52* (2013.01)
USPC ..... 15/257.5; 15/257.1; 15/257.8

(58) Field of Classification Search
CPC ..... A47L 13/52
USPC ..... 15/257.1, 257.5, 257.8, 257.9
See application file for complete search history.

(56) References Cited

U.S. PATENT DOCUMENTS

| | | | | |
|---|---|---|---|---|
| 422,240 | A | 2/1890 | Marshall | |
| 657,243 | A * | 9/1900 | Leib | 15/257.5 |
| 735,565 | A | 8/1903 | McCarthy | |
| 851,441 | A | 4/1907 | Robinson | |
| 1,659,461 | A | 2/1928 | Curran | |
| 1,940,546 | A | 12/1933 | Hower | |
| D398,115 | S | 9/1998 | Footer et al. | |
| 5,826,297 | A | 10/1998 | Footer et al. | |
| D402,780 | S | 12/1998 | Alt | |
| 6,249,930 | B1 | 6/2001 | Noggle | |
| 6,282,745 | B1 | 9/2001 | Alt | |
| 6,698,058 | B2 | 3/2004 | Cann | |
| D599,073 | S | 8/2009 | Caleca | |
| D615,267 | S | 5/2010 | McNeil et al. | |
| D630,401 | S | 1/2011 | Libman et al. | |
| D630,402 | S | 1/2011 | Wang | |
| D667,192 | S * | 9/2012 | Libman et al. | D32/74 |

* cited by examiner

*Primary Examiner* — Randall Chin
(74) *Attorney, Agent, or Firm* — San Diego IP Law Group LLP

(57) ABSTRACT

A dustpan (10) comprises a body (12), a blade (20), and a rear support (22). The body (12) receives materials that are removed from a surface (24). The blade (20) and the rear support (22) are coupled to the body (12). The blade (20) includes a first end (20F), a second end (20S), a first contact point (25A) near the first end (20F), and a second contact point (25B) near the second end (20S). The rear support (22) includes a third contact point (25C) and a fourth contact point (25D). Each of the contact points (25A), (25B), (25C), (25D) contact the surface (24) when the dustpan (10) is in a resting position. Downward pressure on the dustpan (10) establishes firm and continuous contact between the blade (20) and the surface (24) along the length of the blade (20) from the first contact point (25A) to the second contact point (25B).

20 Claims, 4 Drawing Sheets

DUSTPAN

RELATED INVENTION

This application claims domestic priority under 35 U.S.C. §119(e) from U.S. Provisional Application Ser. No. 61/726,802, filed Nov. 15, 2012 and entitled "DUSTPAN". As far as permitted, the contents of U.S. Provisional Application Ser. No. 61/726,802 are incorporated herein by reference.

BACKGROUND

The use of dustpans to pick up, collect and/or remove a mixture of materials, (e.g., dirt, leaves, dust and various other materials) from a surface, such as a floor, is well known. Various designs have been utilized over the years for making and using dustpans. For example, different designs may utilize one piece or multiple piece constructions, may employ metallic, plastic and/or molded materials, and may show numerous ornamental variations. One common design for dustpans consists of a shallow dustpan body with an open edge or "blade" at the front of the dustpan body, and an elongated pedal or grip attached to the rear of the dustpan body. The pedal extends outwardly from the rear of the dustpan body in a generally parallel or slightly angled direction relative to the surface when the dustpan is placed on the surface. The pedal thus provides a handy and convenient means for manipulating the dustpan during use. However, it is often difficult, cumbersome or inconvenient to bend over and hold the dustpan by the pedal while simultaneously sweeping debris into the dustpan. Additionally, such dustpans do not always effectively keep the entire length of the front edge or blade of the dustpan in contact with the surface during use. As a result, at least a portion of the various materials intended to be swept into such dustpans may be swept underneath the dustpan instead of into the body of the dustpan.

SUMMARY

The present invention is directed toward a dustpan usable for removing materials from a surface. In certain embodiments, the dustpan includes a body, a blade, and a rear support. The body receives the materials that are removed from the surface. The blade and the rear support are coupled to the body. The blade includes a first end, an opposed second end, a first contact point near the first end of the blade, and a second contact point near the second end of the blade. The first contact point and the second contact point contact the surface when the dustpan is in a resting, position. Additionally, the rear support includes a third contact point and a fourth contact point. The third contact point and the fourth contact point contact the surface when the dustpan is in the resting position.

The dustpan is designed to enable the user to maintain the blade of the dustpan in firm and continuous contact with the surface to be cleaned during use. For example, in one embodiment, downward pressure on the dustpan between the rear support and the blade moves the dustpan from the resting position to a depressed position and establishes a complete first area of contact between the blade and the surface along the length of the blade from the first contact point to the second contact point. The user can apply this downward pressure between the blade and the rear support, e.g., near the rear support, which thereby causes the blade (i.e. the first area of contact) to press more firmly downward into the surface to be cleaned. With this design, the user does not need to bend over and use his/her hand to tilt the blade into the surface as is often required with conventional dustpans.

In some embodiments, the blade is positioned substantially at or near the forward most portion of the dustpan. Additionally, in one such embodiment, the rear support is positioned substantially at or near the rearward most portion of the dustpan.

In one embodiment, the dustpan further comprises a pedal that extends between and is coupled to the rear support and the body. In this embodiment, downward pressure on the pedal moves the dustpan from the resting position to a depressed position and establishes a complete first area of contact between the blade and the surface along the length of the blade from the first contact point to the second contact point.

Additionally, in one embodiment, the dustpan can further comprise one or more side members that extend between and are coupled to the rear support and the body. In this embodiment, downward pressure on at least one of the one or more side members moves the dustpan from the resting position to a depressed position and establishes a complete first area of contact between the blade and the surface along the length of the blade from the first contact point to the second contact point.

Further, in some embodiments, the dustpan further comprises a bristle cleaner that is incorporated within the body. The bristle cleaner can provide an effective and efficient means for removing any dust and/or debris that may get caught within a plurality of bristles of the brush or broom that is being used with the dustpan. The bristle cleaner can be formed along a top edge of the body. In one embodiment, the bristle cleaner includes a plurality of tines that extend at least approximately one-third a height of the body. Alternatively, the bristle cleaner can include a plurality of tines that extend at least approximately one-half a height of the body.

In one embodiment, the body of the dustpan includes a base, a pair of opposed sides, and a back that cooperate to define a receptacle for receiving the materials that are removed from the surface. In such embodiment, downward pressure on the dustpan between the rear support and the blade moves the dustpan from the resting position to a depressed position and establishes a complete first area of contact between the blade and the surface along the length of the blade from the first contact point to the second contact point. Additionally, when the dustpan is in the depressed position, at least a portion of the base contacts the surface.

Moreover, in certain embodiments, the first contact point, the second contact point, the third contact point and the fourth contact point are the only contact points between the dustpan and the surface when the dustpan is in the resting position.

In another embodiment, the present invention is directed toward a dustpan usable for removing materials from a surface, the dustpan comprising a body that defines a receptacle for receiving the materials that are removed from the surface, the body including a top edge, a height and a bristle cleaner that is formed along the top edge of the body, the bristle cleaner including a plurality of tines that extend at least approximately one-third of the height of the body.

Additionally, in still another embodiment, the present invention is directed toward a dustpan usable for removing materials from a surface, the dustpan comprising (A) a body including a base, a pair of opposed sides, and a back that cooperate to define a receptacle for receiving the materials that are removed from the surface; (B) a blade that is coupled to the body, the blade including (i) a first end, (ii) an opposed second end, (iii) a first contact point near the first end of the blade, and (iv) a second contact point near the second end of the blade, the first contact point and the second contact point contacting the surface when the dustpan is in a resting position; and (C) a rear support that is coupled to the body, the rear support including a third contact point and a fourth contact point, the third contact point and the fourth contact point contacting the surface when the dustpan is in the resting position; wherein downward pressure on the dustpan between the rear support and the blade moves the dustpan from the resting position to a depressed position and establishes a complete first area of contact between the blade and the surface along the length of the blade from the first contact point to the second contact point, and wherein when the dustpan is in the depressed position, at least a portion of the base contacts the surface.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION

Figure 1:
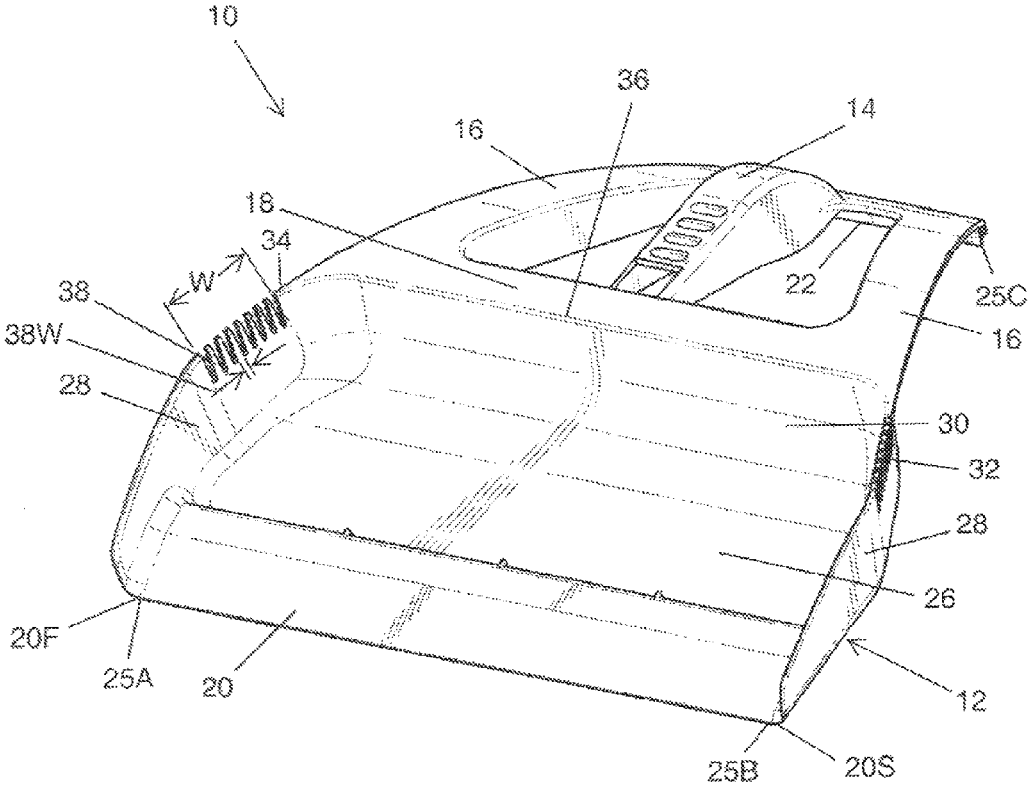
FIG. 1 is a perspective view of an embodiment of a dustpan having features of the present invention.

FIG. 1 is a perspective view of an embodiment of a dustpan 10 having features of the present invention. The design of the dustpan 10 can be varied. As shown in FIG. 1, the dustpan 10 can include a body 12, a pedal 14, a pair of side members 16, one or more cross members 18, a blade 20 and a rear support 22. Alternatively, the dustpan 10 can have a different design. For example, in certain non-exclusive alternative embodiments, the dustpan 10 can include a different number of side members 16, i.e. zero, one or more than two side members 16.

As an overview, the dustpan 10 is uniquely designed to enable the user to maintain the blade 20 of the dustpan 10 in firm and continuous contact with a surface 24 (illustrated in FIG. 3) to be cleaned during use. More particularly, as illustrated and described herein, the dustpan 10 includes four individual contact points i.e. a first contact point 25A, a second contact point 25B, a third contact point 25C, and a fourth contact point 25D (illustrated in FIG. 4), which are at or near the ends 20F, 20S of the blade 20 and at or near the ends of the rear support 22, respectively, at which contact with the surface 24 is consistently maintained. Stated in another manner, the dustpan 10 maintains contact with the surface 24 at two spaced apart areas of the dustpan 10, i.e. the blade 20 and the rear support 22, at all times during use of the dustpan 10. As illustrated and described herein, the blade 20 can constitute and/or include the forward most portion of the dustpan 10. Additionally, in certain embodiments, the rear support 22 can constitute and/or include the rearward most portion of the dustpan 10.

Figure 7:
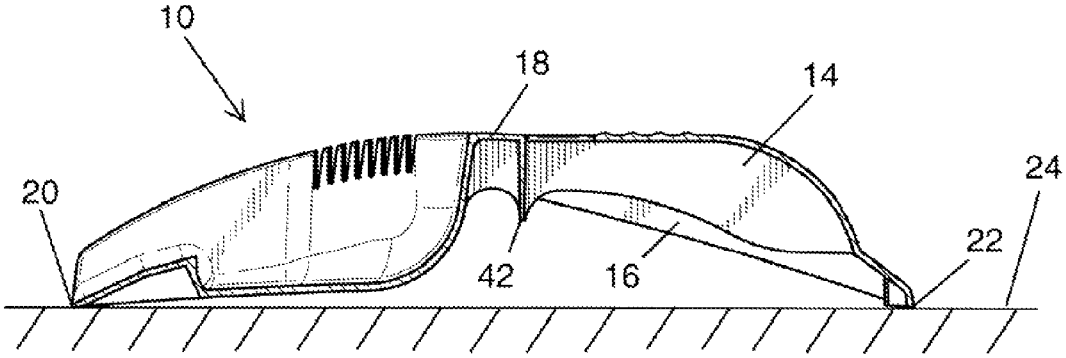
FIG. 7 is a sectional view of the dustpan taken on line 7-7 in FIG. 2, shown in the resting position.
Figure 8:
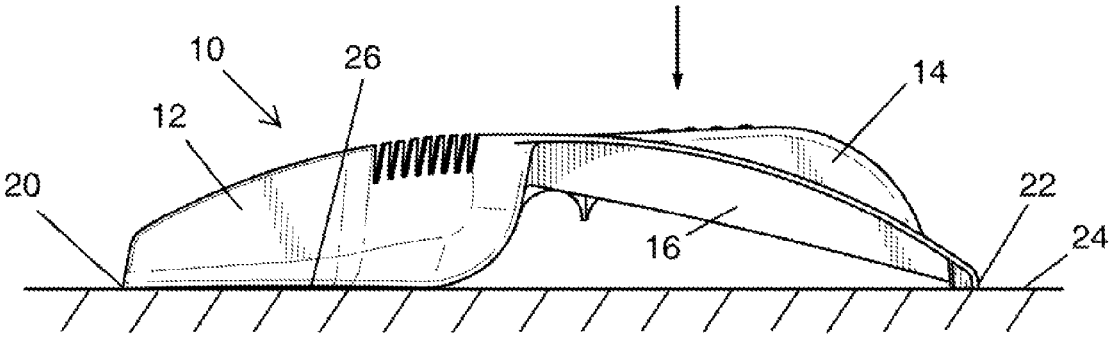
FIG. 8 is a side view of the dustpan illustrated in FIG. 1, shown in a depressed position.

Moreover, the user can apply downward pressure (toward the surface 24) on the dustpan 10 between the rear support 22 and the blade 20 (with the user's foot, for example), e.g., near the rear support 22, which thereby causes the blade 20 to press more firmly downward against the surface 24 to be cleaned. Stated in another manner, when the dustpan 10 is positioned on the surface 24 during use, downward pressure on the dustpan 10 moves the dustpan 10 from a resting position (e.g., as illustrated in FIG. 8 and FIG. 7) and a depressed position (e.g., as illustrated in FIG. 8). For example, the downward pressure can be applied to the raised pedal 14 or either of the side members 16 to move the dustpan 10 from the resting position to the depressed position. With this design, the user does not need to bend over and use his/her hand to tilt the blade 20 into the surface 24 as is often required with conventional dustpans.

The body 12 of the dustpan 10 is adapted to receive the dirt, leaves, dust and various other debris or materials that are desired to be removed from the surface 24. As illustrated, the body 12 can be designed in a manner somewhat similar to a standard dustpan. For example, as shown in FIG. 1, the body 12 of the dustpan 10 can include a base 26, a pair of opposed sides 28, and a back 30 that cooperate to define a receptacle for receiving the dirt, leaves, dust and other materials that are desired to be removed from the surface 24.

In certain embodiments, the body 12 can be formed from a moldable plastic, from various metallic materials, or from other suitable materials. Further, the body 12, i.e. the base 26, the sides 28 and the back 30, can be integrally formed so as to avoid any seams within which the dirt and debris may get trapped during use.

Sometimes during use, some dust or debris may get stuck within a plurality of bristles of the brush or broom (not illustrated) that is being used with the dustpan 10. Thus, as illustrated, in certain embodiments, the dustpan 10 can include a bristle cleaner 32 that can be utilized to remove any such dust or debris from the bristles of the brush or broom that is being used with the dustpan 10. To effectively remove such dust or debris from the bristles of the brush or broom, the bristles are simply moved through the bristle cleaner 32, which dislodges the dust or debris from the bristles so that they can be disposed of with the rest of the materials being removed from the surface 24.

The design of the bristle cleaner 32 can be varied to suit the specific design requirements of the dustpan 10. For example, in the embodiment illustrated in FIG. 1, the bristle cleaner 32 is provided in the form of a comb feature, which can be formed into a top edge 34 of the sides 28 of the body 12 of the dustpan 10. Alternatively, the bristle cleaner 32 can have a different design and/or the bristle cleaner 32 can be positioned at a different location within the dustpan 10.

In the embodiment illustrated in FIG. 1, a separate bristle cleaner 32 is included at the top edge 34 of both sides 28 of the body 12 of the dustpan 10. Alternatively, in other non-exclusive alternative embodiments, the bristle cleaner 32 can be included along the top edge 34 of only one of the sides 28, and/or the bristle cleaner 32 can also be formed along a top edge 36 of the back 30 of the body 12 of the dustpan 10.

Additionally, the bristle cleaner 32 can be of any suitable size, depending on the specific requirements of the dustpan 10. For example, in certain embodiments, the bristle cleaner 32 can have a width W that can be between approximately one inch and five inches. More specifically, in certain non-exclusive alternative embodiments, the width W of the bristle cleaner 32 can be approximately 1.0, 1.5, 2.0, 2.5, 3.0, 3.5, 4.0, 4.5 or 5.0 inches. Still alternatively, the width W of the bristle cleaner 32 can be another suitable value that is greater than five inches, less than one inch, or some other value between one inch and five inches.

Further, as illustrated in FIG. 1, the bristle cleaner 32 can include a plurality of tines 38 that can be used to effectively and efficiently dislodge the dust or debris from the bristles of the brush or broom with which the dustpan 10 is being used. Moreover, as illustrated and described herein, the unique design of the bristle cleaner 32, i.e. the unique design of the tines 38, is better able to remove the unwanted dust or debris along the full length of the bristles of the brush or broom.

The tines 38 on the bristle cleaner 32 can have any suitable size, i.e. any suitable length 38L (illustrated in FIG. 4) and width 38W, depending on the requirements of the bristle cleaner 32 and/or the dustpan 10. For example, in one non-exclusive alternative embodiment, the tines 38 can have a length 38L that extends approximately one-third a height H (illustrated in FIG. 4) of the body 12, i.e. of the sides 28 of the body 12, of the dustpan 10. In non-exclusive, alternative embodiments, the tines 38 can have a length 38L that extends approximately one-fourth, one-half, two-thirds, or three-fourths of the height H of the body 12 of the dustpan 10. Still alternatively, the tines 38 can have a length 38L that extends greater than three-fourths or less than one-fourth the height H of the body 12 of the dustpan 10, or another suitable value between one-fourth and three-fourths the height H of the body 12 of the dustpan 10.

Additionally and/or alternatively, the tines 38 can have a certain length 38L regardless of the overall height H of the body 12 of the dustpan 10. For example, in certain non-exclusive alternative embodiments, the length 38L of the tines 38 can be approximately 0.25, 0.5, 0.75, 1.0, 1.25, 1.5, 1.75 or 2.0 inches. Still alternatively, the length 38L of the tines 38 can be less than 0.25 inches, greater than 2.0 inches, or another suitable value between 0.25 and 2.0 inches.

Further, the width 38W of each of the tines 38 can be varied. For example, in certain non-exclusive alternative embodiments, the width 38W of each of the tines 38 can be approximately one-sixteenth, one-eighth, three-sixteenths, one-fourth, five-sixteenths, or three-eighths inches. Still alternatively, the width 38W of each of the tines 38 can be less than one-sixteenth inches, greater than three-eighths inches, or another suitable value between one-sixteenth and three-eighths inches. Moreover, the tines 38 can have a ratio of the length 38L to the width 38W that can be approximately 1.5:1, 2.0:1, 2.5:1, 3.0:1, 4.0:1, 5.0:1, 6.01, 8.0:1, 10.0:1, 12.0:1, or any other suitable ratio.

Still further, the width 38W and the spacing of the tines 38 can be such that the bristle cleaner 32 includes approximately three, four, five, six, seven or eight tines 38 per inch of the width W of the bristle cleaner 32. Alternatively, the bristle cleaner 32 can include a different number of tines 38 per inch.

The pedal 14 extends in a generally rearward direction away from the body 12 of the dustpan 10. More particularly, in this embodiment, the pedal 14 extends in a rearward direction from at or near the center of the back 30 of the body 12 of the dustpan 10. Additionally, in this embodiment, the pedal 14 extends substantially perpendicularly away from the back 30 of the body 12 of the dustpan 10. Alternatively, the pedal 14 can be positioned in a different orientation relative to the body 12 of the dustpan 10 than that shown in the Figures.

The pedal 14 can be sized and shaped so that the pedal 14 can be easily grasped and gripped by the user of the dustpan 10. Further, as discussed herein, the user of the dustpan 10 can apply downward pressure on the pedal 14, e.g., with the user's foot, to maintain the blade 20, and the rear support 22, in firm and/or continuous contact with the surface 24 during cleaning of the surface 24.

Somewhat similarly, the side members 16 extend in a generally rearward direction away from the body 12 of the dustpan 10. More particularly, in this embodiment, each of the side members 16 extend in a generally rearward direction from at or near the junction between the cross member 18, the back 30 and/or one of the sides 28 of the body 12 of the dustpan 10. Additionally, in this embodiment, each of the side members 16 can be angled in a somewhat inward direction as the side members 16 extend away from the body 12 of the dustpan 10. Alternatively, or in addition, the side members 16 can be angled somewhat toward each other and/or toward the pedal 14 as the side members 16 extend rearwardly toward the rear support 22. As discussed herein, during use, the user can apply downward pressure on one or both of the side members 16, e.g., with the user's foot, to maintain the blade 20, and the rear support 22, in firm and/or continuous contact with the surface 24 during movement of debris from the surface and into the dustpan 10.

It should be noted that, as described herein, maintaining the blade 20 and the rear support 22 in firm contact with the surface 24 during cleaning of the surface 24 can occur by biasing, and thereby maintaining, the four contact points 25A-25D against the surface 24 during cleaning of the surface 24.

The cross member 18 connects the pedal 14 with the side members 16, and further connects the pedal 14 and the side members 16 to the body 12 of the dustpan 10. In particular, in the embodiment illustrated in FIG. 1, the cross member 18 extends substantially horizontally (i.e. relative to the surface 24, during use) away from the back 30 of the body 12 of the dustpan 10 near the top edge 36 of the back 30. In one embodiment, the cross member 18 can be integrally formed with the body 12, the pedal 14 and the side members 16 of the dustpan 10. Alternatively, the cross member 18 can be manufactured as a separate structure, and can be coupled to one or more of the body 12, the pedal 14 and the side members 16 of the dustpan 10 by any suitable manner.

The blade 20 is coupled to the body 12 of the dustpan 10, e.g., to the base 26 and to one or both of the sides 28 of the body 12 of the dustpan 10. In the embodiment illustrated in FIG. 1, the blade 20 is positioned generally forwardly, e.g., away from the back 30, from the base 26 of the body 12 of the dustpan 10. Additionally, the blade 20 can be angled downward slightly, i.e. toward the surface 24, as it extends forwardly from the body 12 of the dustpan 10, to allow for better contact between the blade 20 and the surface 24 during use. In certain embodiments the blade 20 can be integrally formed with the body 12 of the dustpan 10.

As noted above, the blade 20, which can constitute and/or include the forward most portion of the dustpan 10, includes the first contact point 25A and the second contact point 25B between the dustpan 10 and the surface 24. In the embodiment illustrated in FIG. 1, the first contact point 25A is at or near a first end 20F of the blade 20, and the second contact point 25B is at or near a second end 205 of the blade 20. In some embodiments, a center region of the blade 20, i.e. between the first contact point 25A and the second contact point 25B, may be slightly spaced apart from the surface 24 when no downward force is being applied to the dustpan 10, i.e. when the dustpan 10 is in the resting position. However, providing a downward force on the dustpan 10 to move the dustpan 10 to the depressed position, e.g., by depressing the pedal 14 or side members 16 toward the surface 24 as discussed above, helps to firmly establish a complete and/or continuous first area of contact between the dustpan 10 and the surface 24, i.e. between a full length of the blade 20 (from the first contact point 25A to the second contact point 25B) and the surface 24, during cleaning of the surface 24. With this design, a substantial length or the full length of the blade 20 is maintained in firm contact with the surface 24 during use so that the debris being removed from the surface 24 does not get swept underneath the blade 20, i.e. between the blade 20 and the surface 24, during use.

In one embodiment, the blade 20 can be formed from a rubberized material. Alternatively, the blade can be formed from a molded or moldable plastic, from various metallic or composite materials, or from any other suitable materials, which can be similar to or different than the materials used to form the body 12 of the dustpan 10.

The rear support 22 is positioned to connect the pedal 14 with the side members 16 of the dustpan 10. As noted above, the rear support 22, which in certain embodiments constitutes and/or includes the rear most portion of the dustpan 10, includes the third contact point 25C and the fourth contact point 25D of the dustpan 10. Additionally, the third contact point 25C can be at or near one end of the rear support 22, and the fourth contact point 25D can be at or near the other end of the rear support 22. In one embodiment, a center region of the rear support 22, i.e. between the third contact point 25C and the fourth contact point 25D, may be spaced apart from the surface 24. Alternatively, the center region of the rear support 22 may be in substantially continuous contact with the surface 24.

It should be noted that the design of the rear support 22, i.e. the locations of the third contact point 25C and the fourth contact point 25D, should be such that any downward pressure that is applied by the user to the dustpan 10, e.g., on the pedal 14 or the side members 16 toward the surface, occurs substantially between the rear support 22 and the blade 20. Thus, the rear support 22 can be alternatively designed such that the rear support 22 is not the rear most portion of the dustpan 10, so long as the downward pressure is applied substantially between the rear support 22 and the blade 20. Additionally, the locations of the third contact point 25C and the fourth contact point 25D should be such that any downward pressure that is applied to the dustpan 10 occurs substantially between the third contact point 25C and the fourth contact point 25D. Thus, the rear support 22 can be alternatively designed such that the third and fourth contact points 25C, 25D are spaced apart from the ends of the rear support 22, so long as the downward pressure is applied substantially between the third contact point 25C and the fourth contact point 25D.

Further, it should be noted that to the extent that little or no portion of the rear support 22 is spaced apart from the surface 24 between the third and fourth contact points 25C, 25D, providing a downward force on the dustpan 10, e.g., on the pedal 14 or side members 16 as discussed above, helps to firmly establish a complete and/or substantially continuous second area of contact between the dustpan 10 and the surface 24, i.e. between most or all of the entire length of the rear support 22 between the third contact point 25C and the fourth contact point 25D and the surface 24, during cleaning of the surface 24.

Additionally, as discussed herein, when the downward force is provided on the side members 16 and/or the pedal 14, the side members 16, the pedal 14 and/or another portion of the dustpan 10 may flex as needed so that one or both of the blade 20 (i.e. the first area of contact) and the rear support 22 (i.e. the second area of contact) may tend to move slightly along the surface 24 and away from one another in the process of establishing a firmer and/or more continuous contact with the surface 24.

Figure 2:
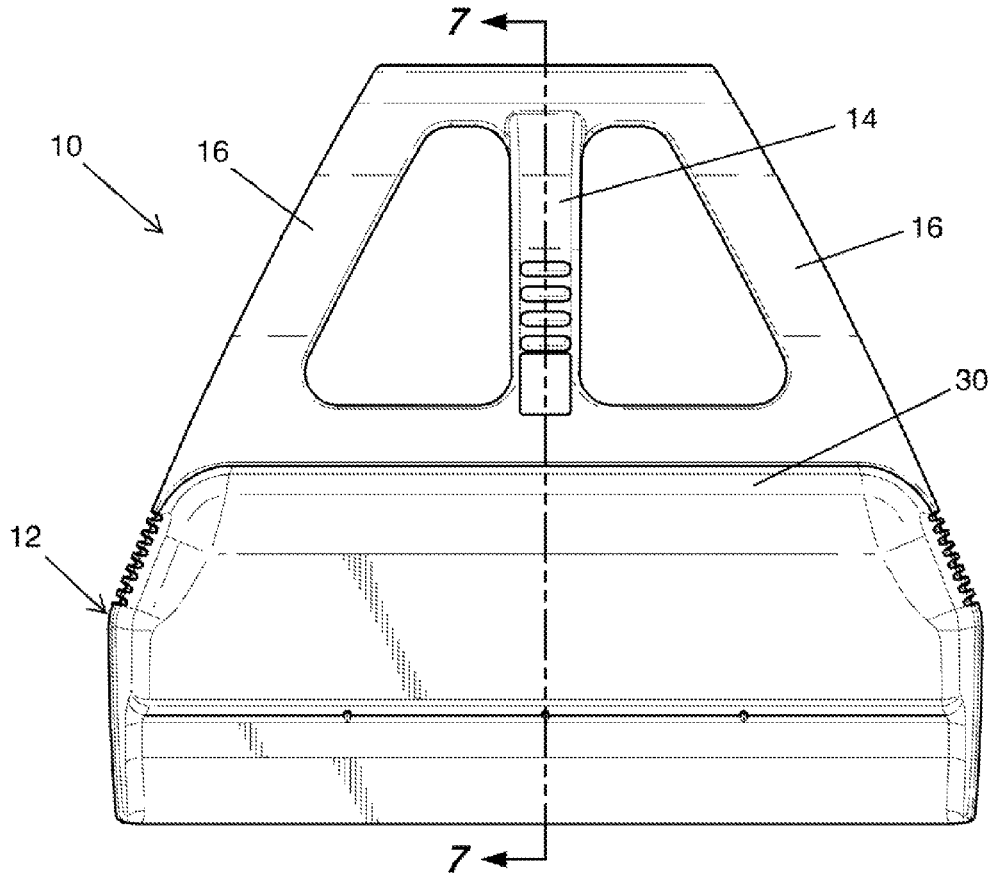
FIG. 2 is a top view of the dustpan illustrated in FIG. 1.

FIG. 2 is a top view of the dustpan 10 illustrated in FIG. 1. FIG. 2 illustrates how, in this embodiment, the pedal 14 can extend in a generally rearwardly direction substantially perpendicular to the back 30 of the body 12 of the dustpan 10. Additionally, FIG. 2 illustrates how, in this embodiment, the side members 16 can extend in a generally rearwardly direction at an angle away from the back 30 of the body 12 of the dustpan 10, so that the side members are angled toward one another and toward the pedal 14 as the side members extend away from the back 30.

Figure 3:
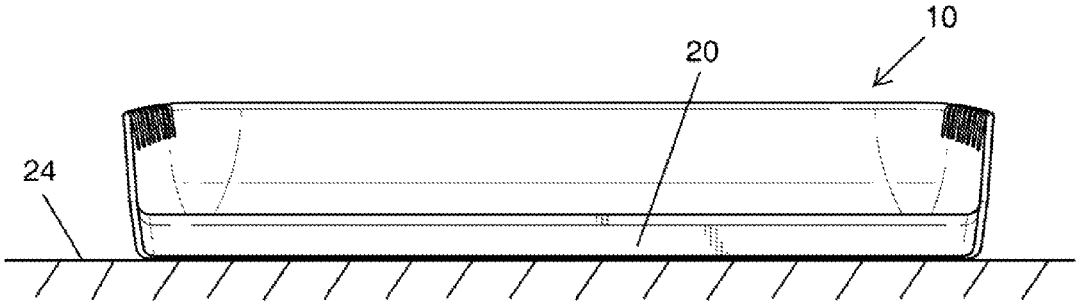
FIG. 3 is a front view of the dustpan illustrated in FIG. 1.

FIG. 3 is a front view of the dustpan 10 illustrated in FIG. 1. FIG. 3 illustrates how the full length of the blade 20 can be maintained in contact with the surface 24 during use. As noted above, with this design, this type of more complete contact between the blade 20 and the surface 24 can increase the likelihood that debris being removed from the surface 24 does not get swept underneath the blade 20 i.e. between the blade 20 and the surface 24, during use of the dustpan 10.

Figure 4:
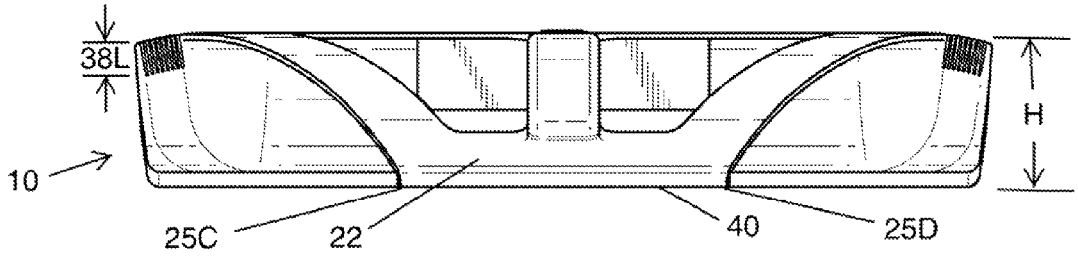
FIG. 4 is a rear view of the dustpan illustrated in FIG. 1.

FIG. 4 is a rear view of the dustpan 10 illustrated in FIG. 1. As shown in FIG. 4, the rear support 22 includes the third contact point 25C and the fourth contact point 25D that can be positioned at or near either end of the rear support 22. Additionally, in this embodiment, the rear support 22 can have a bottom edge 40 that is substantially linear so as to enable a firm and stable area of contact between the rear support 22 and the surface 24 (illustrated in FIG. 3) during use. Alternatively, the rear support 22 can be designed with other than a linear bottom edge 40, so long as the third and fourth contact points 25C, 25D are able to maintain contact with the surface 24 at the same time to ensure a firmer and more stable, i.e. non-wobbly, contact between the rear support 22 and the surface 24 during use.

Figure 5:
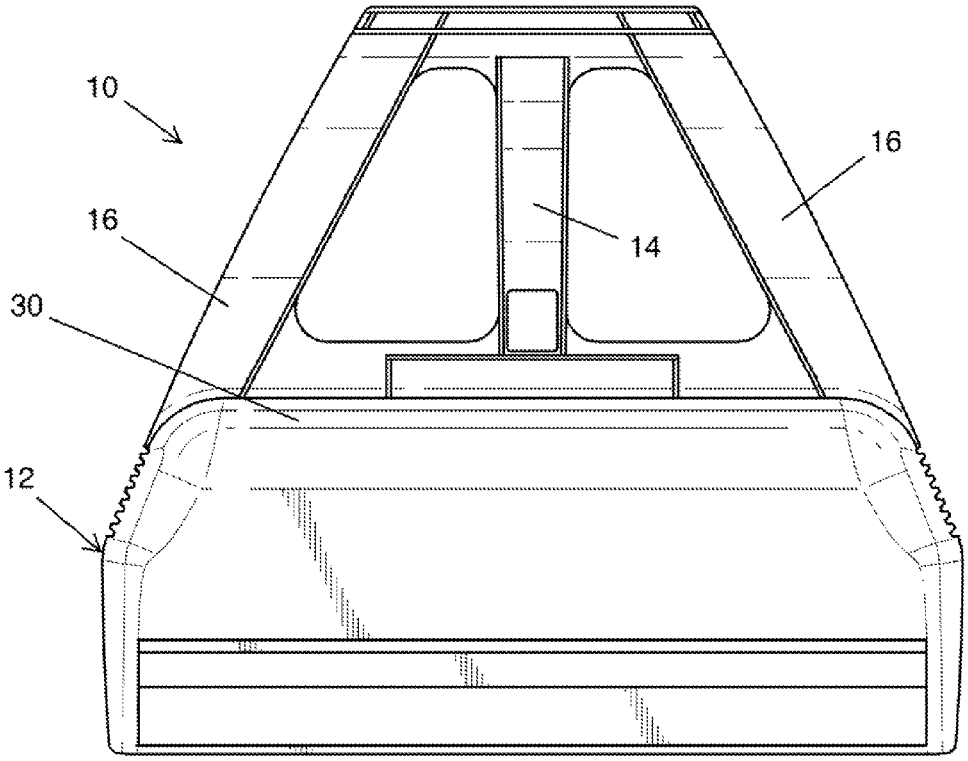
FIG. 5 is a bottom view of the dustpan illustrated in FIG. 1.

FIG. 5 is a bottom view of the dustpan 10 illustrated in FIG. 1. Similar to FIG. 2, FIG. 5 again illustrates how, in this embodiment, the pedal 14 can extend in a generally rearwardly direction substantially perpendicular to the back 30 of the body 12 of the dustpan 10. Additionally, FIG. 5 also illustrates how, in this embodiment, the side members 16 extend in a generally rearwardly direction at an angle away from the back 30 of the body 12 of the dustpan 10, so that the side members are angled toward one another and toward the pedal 14 as the side members extend away from the back 30.

Figure 6:
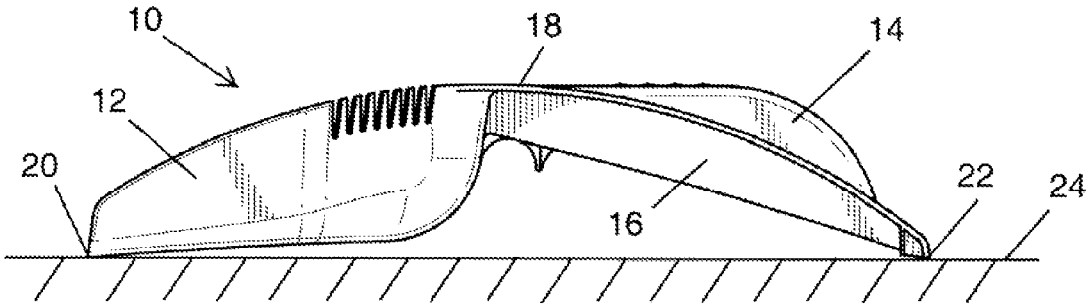
FIG. 6 is a side view of the dustpan illustrated in FIG. 1, shown in a resting position.

FIG. 6 is a side view of the dustpan 10 illustrated in FIG. 1, with the dustpan 10 being in the resting position. As illustrated in the embodiment in FIG. 6, the blade 20 contacts the surface 24 at a forward most portion of the dustpan 10, and the rear support 22 contacts the surface 24 at a rearward most portion of the dustpan 10. Additionally, as illustrated, when the dustpan 10 is in the resting position, the body 12 of the dustpan 10 extends upward at a slight angle away from the first area of contact between the blade 20 and the surface 24, such that no portion of the body 12 of the dustpan 10 will typically have any contact with the surface 24. Somewhat similarly, as illustrated, the pedal 14 and the side members 16 extend upward at an angle from the rear support, i.e. from the second area of contact between the rear support 22 and the surface 24, such that no portion of the pedal 14 or the side members 16 will typically have any contact with the surface 24.

Additionally, with the pedal 14 and the side members 16 being spaced apart from the surface 24, when the user provides a downward force on, e.g., steps down on, the pedal 14 and/or one or both of the side members 16, the dustpan 10 will flex downwardly toward the middle of the dustpan 10, e.g., near the cross member 18 that connects the pedal 14 and the side members 16 to the body 12 of the dustpan 10. Further, as the dustpan 10 flexes downwardly toward the middle of the dustpan 10, one or both of the blade 20 (i.e. the first area of contact) and the rear support 22 (i.e. the second area of contact) may tend to move slightly along the surface 24 and away from one another in the process of establishing a firmer contact with the surface 24. With this design, a firm and secure area of contact can be effectively maintained between the blade 20 and the surface 24, and between the rear support 22 and the surface 24, at all times during use of the dustpan 10. Moreover, with such design, the user does not need to bend over and use his/her hand to tilt the blade 20 into the surface 24 as is often required with conventional dustpans.

FIG. 7 is a sectional view of the dustpan 10 taken on line 7-7 in FIG. 2, with the dustpan 10 again being shown in the resting position. More particularly, FIG. 7 illustrates a sectional view that cuts through the center of the pedal 14 of the dustpan 10.

Similar to what is illustrated in FIG. 6, FIG. 7 also illustrates that the blade 20 establishes the first area of contact with the surface 24 at the forward most portion of the dustpan 10, and that the rear support 22 establishes the second area of contact at the rearward most portion of the dustpan 10.

Additionally, FIG. 7 further illustrates one embodiment for a connection zone 42 between the cross member 18 and the pedal 14 that enables the desired flexing of the dustpan 10 when a downward force is placed on the pedal 14 and/or one or both of the side members 16 during use. Further, the design of the connection zone 42 can absorb at least some of the stress that may otherwise be placed on the cross member 18, the pedal 14, and/or the side members 16, and, thus, inhibit fatigue on the materials used to manufacture the dustpan 10, which may otherwise damage the integrity of the dustpan 10.

FIG. 8 is a side view of the dustpan illustrated in FIG. 1, with the dustpan 10 being shown in the depressed position. More particularly, FIG. 8 illustrates that a downward force on the dustpan 10 (illustrated with a downward facing arrow), e.g., on the pedal 14 and/or one or both of the side members 16, has moved the dustpan 10 from the resting position to the depressed position.

FIG. 8 again illustrates that the blade 20 can contact the surface 24 at the forward most portion of the dustpan 10, and the rear support 22 can contact the surface 24 at the rearward most portion of the dustpan 10. Additionally, as illustrated, when the dustpan 10 is in the depressed position, the body 12 of the dustpan 10 has moved downward toward the surface 24 such that at least a portion of the base 26 of the body 12 of the dustpan 10 is in contact with the surface 24. For example, in certain embodiments, when the dustpan 10 is in the depressed position, some or substantially all of the base 26 of the body 12 of the dustpan 10 can be in contact with the surface 24. By having the base 26 of the body 12 of the dustpan 10 contact the surface 24 in such a manner when the dustpan 10 is moved to the depressed position, the dustpan 10 is inhibited from "over-flexing" during use, which may otherwise tend to increase fatigue on one or more elements of the dustpan 10. Moreover, the contact between the base 26 and the surface 24 when the dustpan 10 is in the depressed position improves the stability of the dustpan 10 and also helps to more firmly maintain the blade 20 in firm and/or continuous contact with the surface 24 during cleaning of the surface 24.

While a number of exemplary aspects and embodiments of a dustpan 10 have been shown and disclosed herein above, those of skill in the art will recognize certain modifications, permutations, additions and sub-combinations thereof. It is therefore intended that the dustpan 10 shall be interpreted to include all such modifications, permutations, additions and sub-combinations as are within their true spirit and scope, and no limitations are intended to the details of construction or design herein shown.

What is claimed is:

1. A dustpan usable for removing materials from a surface, the dustpan comprising:

a body that is adapted to receive the materials that are removed from the surface;

a blade that is coupled to the body, the blade including (i) a first end, (ii) an opposed second end, (iii) a first contact point near the first end of the blade, and (iv) a second contact point near the second end of the blade, the first contact point and the second contact point contacting the surface when the dustpan is in resting position; and a pedal, a pair of side members, a cross member, and a rear support that are coupled to the body, wherein the rear support is in contact with the surface, the pedal extends in a rearward direction from a center of a back of the body, the pair of side members extend in a rearward direction from sides of the body and are angled toward each other, the cross member connects the pedal with the side members, and further connects the pedal and the side members to the body, the rear support including a third contact point and a fourth contact point contacting the surface when the dustpan is in the resting position.

2. The dustpan of claim 1 wherein downward pressure on the dustpan between the rear support and the blade moves the dustpan from the resting position to a depressed position and establishes a complete first area of contact between the blade and the surface along the length of the blade from the first contact point to the second contact point.

3. The dustpan of claim 1 wherein the blade is positioned substantially at the forward most portion of the dustpan.

4. The dustpan of claim 1 wherein the rear support is positioned substantially at the rearward most portion of the dustpan.

5. The dustpan of claim 1 wherein downward pressure on the pedal moves the dustpan from the resting position to a depressed position and establishes a complete first area of contact between the blade and the surface along the length of the blade from the first contact point to the second contact point.

6. The dustpan of claim 1 wherein downward pressure on at least one of the one or more side members moves the dustpan from the resting position to a depressed position and establishes a complete first area of contact between the blade and the surface along the length of the blade from the first contact point to the second contact point.

7. The dustpan of claim 1 further comprising a bristle cleaner that is incorporated within the body, the bristle cleaner being formed along a top edge of the body, the bristle cleaner including a plurality of tines that extend at least approximately one-half a height of the body.

8. The dustpan of claim 1 wherein the body includes a base, a pair of opposed sides, and a back that cooperate to define a receptacle for receiving the materials that are removed from the surface.

9. The dustpan of claim 8 wherein downward pressure on the dustpan between the rear support and the blade moves the dustpan from the resting position to a depressed position and establishes a complete first area of contact between the blade and the surface along the length of the blade from the first contact point to the second contact point, and wherein when the dustpan is in the depressed position, at least a portion of the base contacts the surface.

10. A dustpan usable for removing materials from a surface, the dustpan comprising:

a body that is adapted to receive the materials the materials that are removed from the surface;

a blade that is coupled to the body, the blade including (i) a first end, (ii) an opposed second end, (iii) a first contact point near the first end of the blade, and (iv) a second contact point near the second end of the blade, the first contact point and the second contact point contacting the surface when the dustpan is in resting position; and a rear support that is coupled to the body, the rear support including a third contact point and a fourth contact point contacting the surface when the dustpan is in the resting position, wherein the first contact point, the second contact point, the third contact point and the fourth contact point are the only contact points between the dustpan and the surface when the dustpan is in the resting position.

11. A dustpan usable for removing materials from a surface, the dustpan comprising:

a body that defines a receptacle for receiving the materials that are removed from the surface, the body including a top edge, a height and a bristle cleaner that is formed along the top edge of the body, the bristle cleaner including a plurality of tines that extend at least approximately one-third of the height of the body; and a pedal, a pair of side members, a cross member, and a rear support that are coupled to the body, wherein the rear support is in contact with the surface, the pedal extends in a rearward direction from a center of a back of the body, the pair of side members extend in a rearward direction from sides of the body and are angled toward each other, the cross member connects the pedal with the side members, and further connects the pedal and the side members to the body.

12. The dustpan of claim 11 wherein the plurality of tines extend at least approximately one-half the height of the body.

13. The dustpan of claim 11 further comprising a blade that is coupled to the body, the blade including (i) a first end, (ii) an opposed second end, (iii) a first contact point near the first end of the blade, and (iv) a second contact point near the second end of the blade, the first contact point and the second contact point contacting the surface when the dustpan is in a resting position.

14. The dustpan of claim 13 wherein the blade is positioned substantially at the forward most portion of the dustpan.

15. The dustpan of claim 13 wherein the rear support including a third contact point and a fourth contact point, the third contact point and the fourth contact point contacting the surface when the dustpan is in resting position.

16. The dustpan of claim 15 wherein downward pressure on the pedal moves the dustpan from the resting position to a depressed position and establishes a complete first area of contact between the blade and the surface along the length of the blade from the first contact point to the second contact point.

17. The dustpan of claim 15 wherein downward pressure on at least one of the one or more side members moves the dustpan from the resting position to a depressed position and establishes a complete first area of contact between the blade and the surface along the length of the blade from the first contact point to the second contact point.

18. The dustpan of claim 15 wherein the body includes a base, a pair of opposed sides, and a back that cooperate to define a receptacle for receiving the materials that are removed from the surface, wherein downward pressure on the dustpan between the rear support and the blade moves the dustpan from the resting position to a depressed position and establishes a complete first area of contact between the blade and the surface along the length of the blade from the first contact point to the second contact point, and wherein when the dustpan is in the depressed position, at least a portion of the base contacts the surface.

19. A dustpan usable for removing materials from a surface, the dustpan comprising:

a body including a base, a pair of opposed sides, and a back that cooperate to define a receptacle for receiving the materials that are removed from the surface;

a blade that is coupled to the body, the blade including (i) a first end, (ii) an opposed second end, (iii) a first contact point near the first end of the blade, and (iv) a second contact point near the second end of the blade, the first contact point and the second contact point contacting the surface when the dustpan is in resting position; and a pedal, a pair of side members, a cross member, and a rear support that are coupled to the body, wherein the rear support is in contact with the surface, the pedal extends in a rearward direction from a center of a back of the body, the pair of side members extend in a rearward direction from sides of the body and are angled toward each other, the cross member connects the pedal with the side members, and further connects the pedal and the side members to the body, the rear support including a third contact point and a fourth contact point, the third contact point and the fourth contact point contacting the surface when the dustpan is in the resting position;

wherein downward pressure on the dustpan between the rear support and the blade moves the dustpan from the resting position to a depressed position and establishes a complete first area of contact between the blade and the surface along the length of the blade from the first contact point to the second contact point, and wherein when the dustpan is in the depressed position, at least a portion of the base contacts the surface.

20. The dustpan of claim 19 further comprising a bristle cleaner that is incorporated within the body, the bristle cleaner being formed along a top edge of the body, the bristle cleaner including a plurality of tines that extend at least approximately one-half a height of the body.

* * * * *